US008823474B2

(12) United States Patent
Kakimoto et al.

(10) Patent No.: US 8,823,474 B2
(45) Date of Patent: Sep. 2, 2014

(54) CONTACT SWITCHING MECHANISM AND ELECTROMAGNETIC RELAY

(71) Applicant: Omron Corporation, Kyoto (JP)

(72) Inventors: Toshiyuki Kakimoto, Yasu (JP); Tetsuo Shinkai, Yamaga (JP); Yasuyuki Masui, Kumamoto (JP); Tsukasa Yamashita, Yamaga (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 13/657,434

(22) Filed: Oct. 22, 2012

(65) Prior Publication Data

US 2013/0113581 A1 May 9, 2013

(30) Foreign Application Priority Data

Nov. 4, 2011 (JP) ..... 2011-242446

(51) Int. Cl.

| | |
|---|---|
| ***H01H 73/18*** | (2006.01) |
| ***H01H 9/46*** | (2006.01) |
| ***H01H 50/26*** | (2006.01) |
| *H01H 9/44* | (2006.01) |
| *H01H 1/20* | (2006.01) |

(52) U.S. Cl.

CPC ..... *H01H 9/46* (2013.01); *H01H 9/443* (2013.01); *H01H 50/26* (2013.01); *H01H 1/2066* (2013.01)

USPC ..... 335/201; 218/23

(58) Field of Classification Search

CPC ..... H01H 73/18; H01H 51/287

USPC ..... 335/201; 218/23–28

See application file for complete search history.

(56) References Cited

U.S. PATENT DOCUMENTS 2,813,953 A * 11/1957 Eaton ..... 218/22
5,109,146 A * 4/1992 Maenishi ..... 218/26

FOREIGN PATENT DOCUMENTS

| | | |
|---|---|---|
| EP | 0 341 690 | 11/1989 |
| JP | 2006-196372 | 7/2006 |
| JP | 2010-170876 | 8/2012 |

* cited by examiner

*Primary Examiner* — Ramon Barrera
(74) *Attorney, Agent, or Firm* — Foley & Lardner LLP

(57) ABSTRACT

To promptly extinguish an arc generated between contacts with a simple and inexpensive structure without negatively influencing the spring property of a movable contact piece. A contact switching mechanism includes a fixed contact piece with a fixed contact and a movable contact piece with a movable contact which faces the fixed contact in a contactable manner. At least either one of the contact pieces is provided with an extension which extends toward the contact of the remaining contact piece.

14 Claims, 13 Drawing Sheets

CONTACT SWITCHING MECHANISM AND ELECTROMAGNETIC RELAY

TECHNICAL FIELD

The present embodiments relate to a contact switching mechanism and an electromagnetic relay including a contact switching mechanism, and more particularly to a power relay.

BACKGROUND ART

Conventionally, there is a known contact switching mechanism where a projection piece for terminating extension of an arc is formed at either one side end, out of a left side end and a right side end, of a leaf spring provided with a movable contact (for example, refer to Japanese Unexamined Patent Publication No. 2006-196372).

However, in the conventional contact switching mechanism, the arc generated between contacts is extended by the action of magnetic force and is terminated by the projection piece, where the position of the projection piece from the contacts is farther than a distance between the contacts. For this reason, there is a concern that the position of termination is not coincident with that of the projection piece when the arc actually occurs.

Another known contact switching mechanism is provided with a fixed electrode provided with an arc-runner conductor provided with a protrusion. With this structure, the arc generated between a movable electrode contact and a fixed electrode contact in an electrode open state is communicated between a distal end of the movable electrode and the protrusion (for example, refer to Japanese Unexamined Patent Publication No. 2010-170876).

However, in the conventional contact switching mechanism, the arc-runner conductor needs to be attached to the electrode as an additional member, and furthermore an additional process for providing the protrusion to the arc-runner conductor needs to be performed. For such a reason, there are problems in that the structure of a conventional contact switching mechanism is complicated and the cost of a conventional contact switching mechanism is increased.

SUMMARY

The present embodiments are intended to provide a contact switching mechanism and an electromagnetic relay that can promptly extinguish an arc generated between contacts with a simple and inexpensive structure without negatively influencing the spring property of a movable contact piece.

In accordance with one aspect of the present embodiments, in order to solve the above problem, there is provided a contact switching mechanism including a fixed contact piece with a fixed contact and a movable contact piece with a movable contact that faces the fixed contact in a contactable manner, wherein the fixed contact piece includes a first fixed portion that is configured to fix to a base and a first main body portion that is configured to protrude from the base and includes the fixed contact and the movable contact piece includes a second fixed portion fixed to the base and a second main body portion that protrudes from the base and includes the movable contact, at least one of the fixed contact piece and the movable contact piece include an extension that extends toward the fixed contact or the movable contact provided for the remaining at least one of the fixed contact piece and the movable contact piece, the extension is at a side opposite to one of the first fixed portion and the second fixed portion, with one of the fixed contact and the movable contact interposed between.

With this configuration, the arc generated between the contacts is reliably led to the extension and thus rapidly extinguished. Moreover, even if the extension is damaged when the arc is extinguished, the damaged portion may be a region which is irrelevant to a conductive portion. Furthermore, when the distance from the conductive region of the contact piece to the position of the distal end of the extension is sufficiently increased, a structure which is sufficiently resistant to the arc-originating damage can be configured.

The extension preferably protrudes by a dimension which is more than that of the contact which protrudes from the main body portion.

With this configuration, it is possible to far more effectively extinguish the arc generated between the contacts.

The extension is preferably formed by bending the main body portion.

In this case, the main body portion may be bent at a substantially right angle.

A magnet that extends the arc generated between the contacts to the extension is preferably provided.

With this configuration, since the arc generated between the contacts is extended to the extension, the arc can be far more effectively extinguished.

In accordance with another aspect of the present embodiments, in order to solve the above problem, there is provided an electromagnetic relay including any of the contact switching mechanisms described above.

According to the present embodiments, at least one of contact pieces is provided with an extension which extends to a contact provided for the remaining contact piece. Accordingly, the arc generated between the contacts can be reliably extended to the extension so that the arc can be rapidly extinguished.

DETAILED DESCRIPTION

Figure 1:
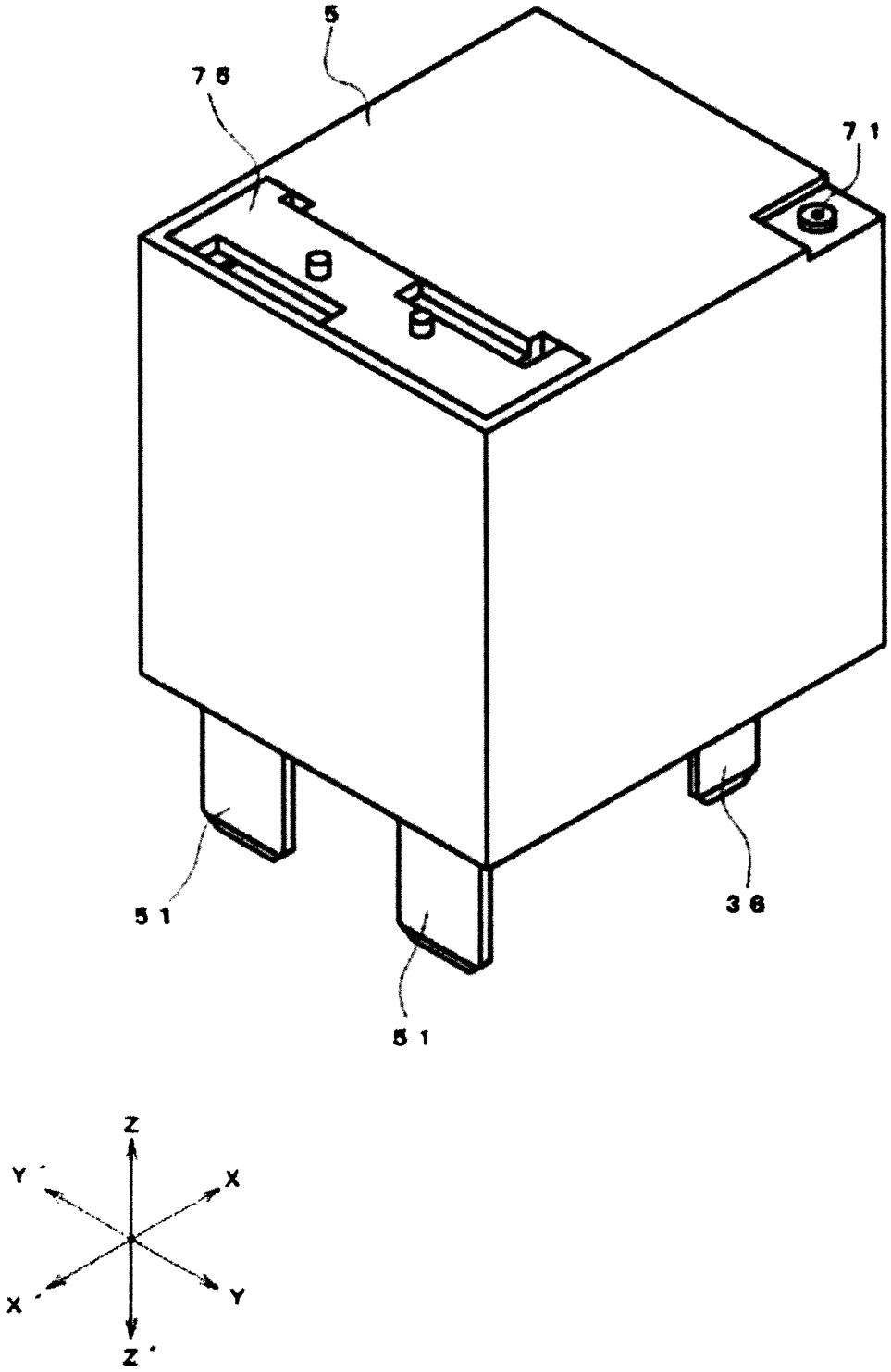
FIG. 1 is a perspective view illustrating an electromagnetic relay according to an embodiment.

Hereinafter, preferred embodiments will be described with reference to the drawings. Note that in the description below, terms that refer to specific directions and positions (for example, terms including "upper", "lower", "side", and "end") are used if necessary. The purpose of using the terms is to help one better understand the present embodiments referenced in the drawings, but the technical scope of the present embodiments is not be limited by the meanings of the terms. The description hereinbelow represents an example of the present embodiments and is not limiting.

1. Overall Structure

FIGS. 1 to 5 illustrate an electromagnetic relay according to an embodiment. As it relates to the electromagnetic relay, an electromagnet block 2, a contact switching unit 3, and a movable iron piece 4 are installed on a base 1, and the whole structure is encased in a case 5. A power relay in which an application voltage is 400 V and a quantity of electricity is 20 A is used.

1-1. Base 1

Figure 6A:
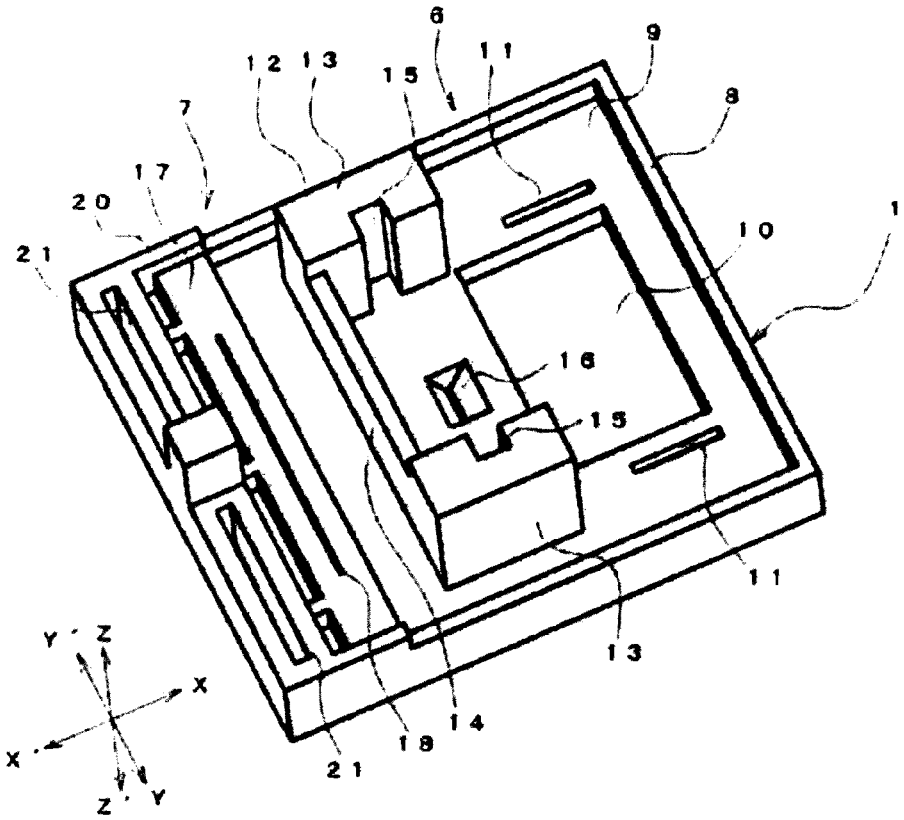
FIG. 6A is a perspective view illustrating a base viewed from above.
Figure 6B:
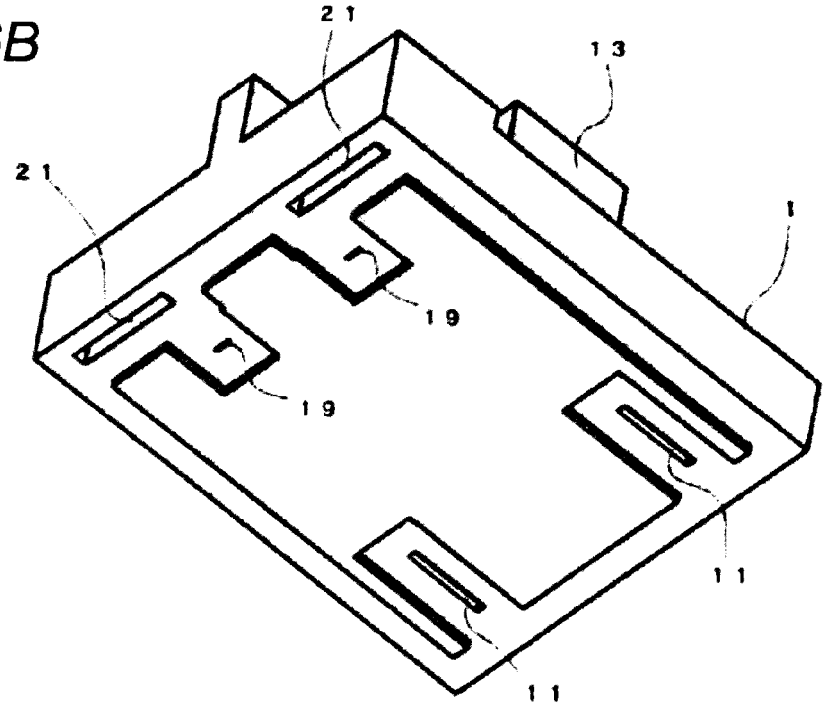
FIG. 6B is a perspective view illustrating the base viewed from below.

The base 1 is rectangular in a plan view and is formed by performing a molding process with a synthetic resin material as shown in FIGS. 6A and 6B. In the base 1, there are two installation areas including a first installation portion 6 and a second installation portion 7 arranged in a longitudinal direction. Hereafter, the longitudinal direction running along a longer side is referred to as an X-axis, a lateral direction running along a shorter side is referred to as a Y-axis, and a direction running along the height is referred to as a Z-axis.

The first installation portion 6 is an area reserved for installation of the electromagnet block 2 to be described later and is configured in a manner that a supporting concave portion 10 is formed in a recess 9 surrounded with a first periphery wall 8 formed on an upper surface of the base 1 and with a second installation portion 7. In the bottom of the recess 9, a pair of coil terminal holes 11 that completely pass through the bottom of the recess 9 from the upper side to the lower side are formed at both sides of the supporting concave portion 10 in the lateral direction of the base 1 (the direction of YY').

A guide portion 12 is formed near the supporting concave portion 10 (in the longitudinal direction of the base 1). The guide portion 12 includes a pair of guide walls 13 which are formed to correspond to the shorter-side direction (the direction of YY'), and an insulation wall 14 that connects the pair of guide walls 13. Guide grooves 15, each of which vertically extends, are formed in opposing surfaces of the guide walls 13. Both sides of a yoke 41, to be described later, are guided by the guide grooves 15. Moreover, a guide concave portion 16 is formed at a center portion of an area surrounded by the guide walls 13 and the insulation wall 14. A to-be-guided portion 50 of a hinge spring 44, to be described later, is located in the guide concave portion 16.

The second installation portion 7 is an area reserved for the contact switching unit 3. A plinth 17 having the same height as the first periphery wall 8 of the first installation portion 6 is formed in the second installation portion 7. In the plinth 17, a slit-like first terminal hole 18 extending in the direction of YY' is formed. The first terminal hole 18 passes through the bottom of the base 1 only at two locations where communicating portions 19 are formed. A movable contact piece 52, to be described later, is press-fitted into the first terminal hole 18. A second periphery wall 20 is formed at three of the four sides of the plinth 17. The fourth side that is near the first installation portion 6. A part of the second periphery wall 20, which is disposed on the side of the X' direction side, is relatively thick and has a pair of slit-like second terminal holes 21, which extend and are arranged in the direction of YY'.

1-2. Electromagnet Block 2

Figure 7:
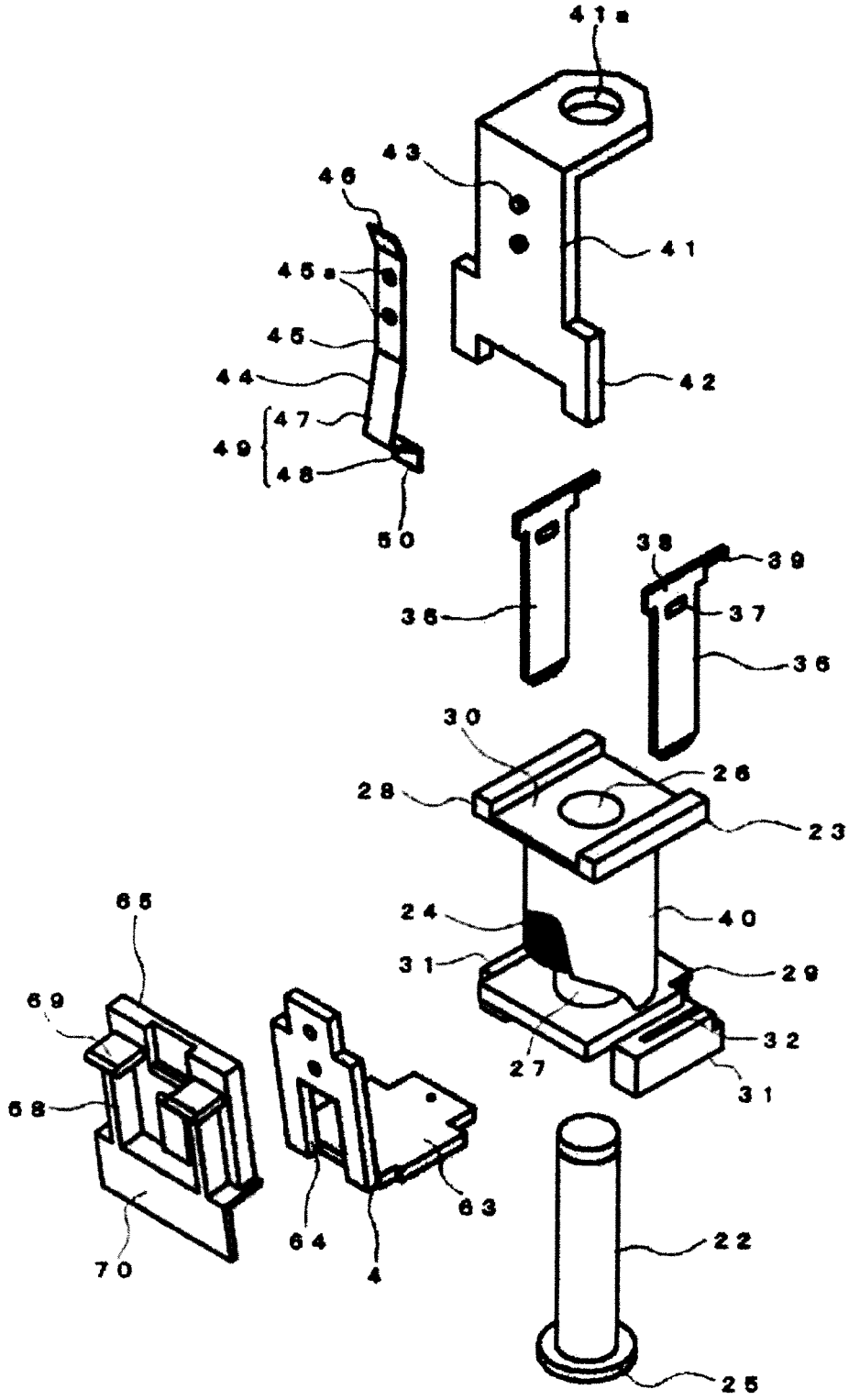
FIG. 7 is an exploded perspective view of an electromagnet block and a movable iron piece shown in FIG. 2.
Figure 8:
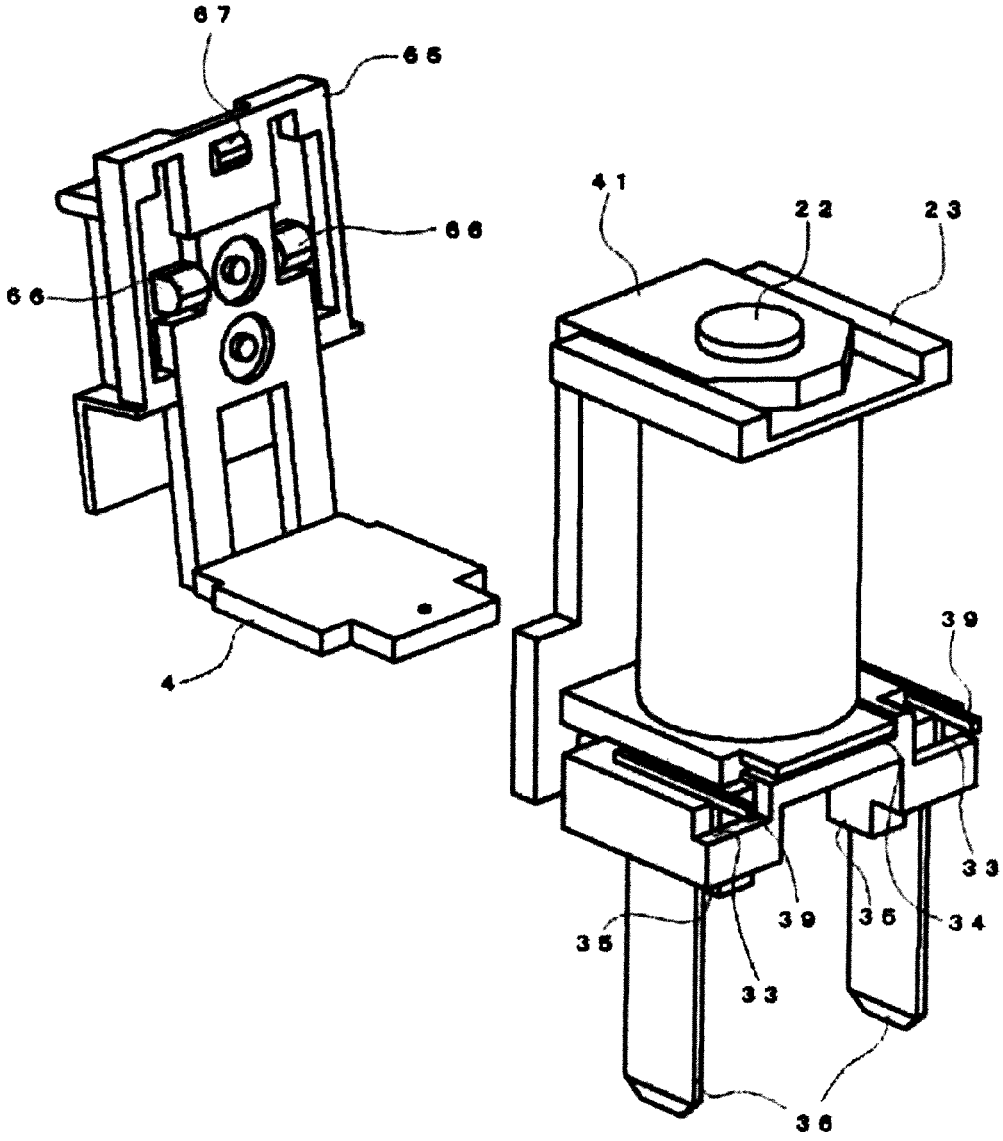
FIG. 8 is an exploded perspective view of the electromagnet block and the movable iron piece shown in FIG. 2.

As illustrated in FIGS. 7 and 8, the electromagnet block 2 is a structure formed by winding a coil 24 around an iron core 22 using a spool 23.

The iron core 22 is a bar of an electromagnetic material. As for the iron core 22, a flange-like magnetic pole portion 25 is formed at a lower end of the iron core 22 and the yoke 41 is fastened to an upper end of the iron core 22.

The spool 23 is obtained by performing a molding process with a synthetic resin material, and includes a cylindrical trunk 27 having a center hole 26 formed in the cylindrical trunk 27 and flanges (an upper-end flange 28 and a lower-end flange 29). The upper-end flange is formed at an upper end of the cylindrical trunk 27 and the lower-end flange 29 is formed at a lower end of the cylindrical trunk 27.

In an upper surface of the upper-end flange 28, a relief groove 30 is formed and the center hole 26 is open. An end of the yoke 41, to be described later, is disposed in the relief groove 30. The center hole 26 is also open in the lower-end flange 29 and the iron core 22 can be inserted into the center hole 26 from the lower-end flange 29.

Terminal attachment portions 31 are provided at both sides of the lower-end flange 29, and a terminal holding hole 32 is formed in each of the terminal attachment portions 31. Coil terminals 36, to be described later, are press-fitted in and each of the coil terminals 36 is fixed to a respective one of the terminal holding holes 32. Step portions 33 are formed on both sides of an end of the terminal attachment portion 31, and coil winding portions 39 of the coil terminals 36, which are press-fitted in the terminal holding holes 32 to be fixed project over a respective one of the step portions 33. Moreover, the lower-end flange 29 has a guide groove 34 that communicates with one of the step portions 33 via a way from the trunk 27 to a side end surface of the trunk 27. An end of the coil 24 (a beginning end of turns of the coil 24) wound around the trunk 27 is disposed in the guide groove 34, and the coil 24 is wound around the coil winding portion 39 of the coil terminal 36 which projects over the step portion 33. A pair of guide protrusions 35 are provided in the bottom surface of the lower-end flange 29 at a predetermined interval. The guide protrusions 35 serve to position the spool 23. In other words, the guide protrusions 35 serve to position the electromagnet block 2 with respect to the base 1 by being put in the supporting concave portions 10 of the base 1.

The coil terminal 36 is a plate-like body of an electrically conductive material, and its lower end portion is tapered to the bottom such that the width and thickness are gradually decreased toward the bottom. The coil terminal 36 has a press-fitted portion 37 which is expanded from one surface of the plate-like body through a press-working process at an upper end portion of the plate-like body, and a portion of the coil terminal 36 on the upper side of the press-fitted portion 37 is formed as a wide width portion 38. The coil winding portion 39 projects from one end of the wide width portion 38.

The coil 24 is wound around the trunk 27 of the spool 23, and an insulation sheet 40 is attached to the outer circumferential surface of the coil 24. One end of the coil 24 is arranged in the guide groove 34 of the spool 23, and the coil 24 is then wound around the trunk 27 of the spool 23. After that, both ends of the coil 24 are wound around the coil winding portion 39 of the coil terminal 36, and then soldered to be fixed.

The yoke 41 is fastened to an end of the iron core 22. The yoke 41 is made of a magnetic material and has a bent body that is substantially L shape-shaped. An end of the yoke 41 is provided with an opening 41*a* so that an end of the iron core 22 is inserted in the opening 41*a* so as to be fastened to the end of the yoke 41. The other end of the yoke 41 is a wide width portion, and one of the protruding portions 42 is provided at either side of a lower end of the wide width portion. The movable iron piece 4, to be described later, is located between both the protruding portions 42, and one corner of the protruding portions 42 functions as a fulcrum on which the movable iron piece 4 is movably supported. In a middle portion of the yoke 41, two fastening projections 43 are formed on an outside surface of the yoke 41 and they are arranged on a vertical line.

A hinge spring 44 is fastened to the middle portion of the yoke 41 by using the projections 43. However, the method of fixing the hinge spring 44 to the yoke 41 is not limited to the fastening, but a different method such as ultrasonic welding, resistance welding, laser welding, or the like may be used.

The hinge spring 44 includes a joint portion 45 that comes in contact with the outside surface of the middle portion of the yoke 41. The joint portion 45 has through-holes 45*a* at two locations and the projections 43 of the yoke 41 are inserted into the through-holes 45 so as to be fastened.

1-3. Contact Switching Unit 3

Figure 4:
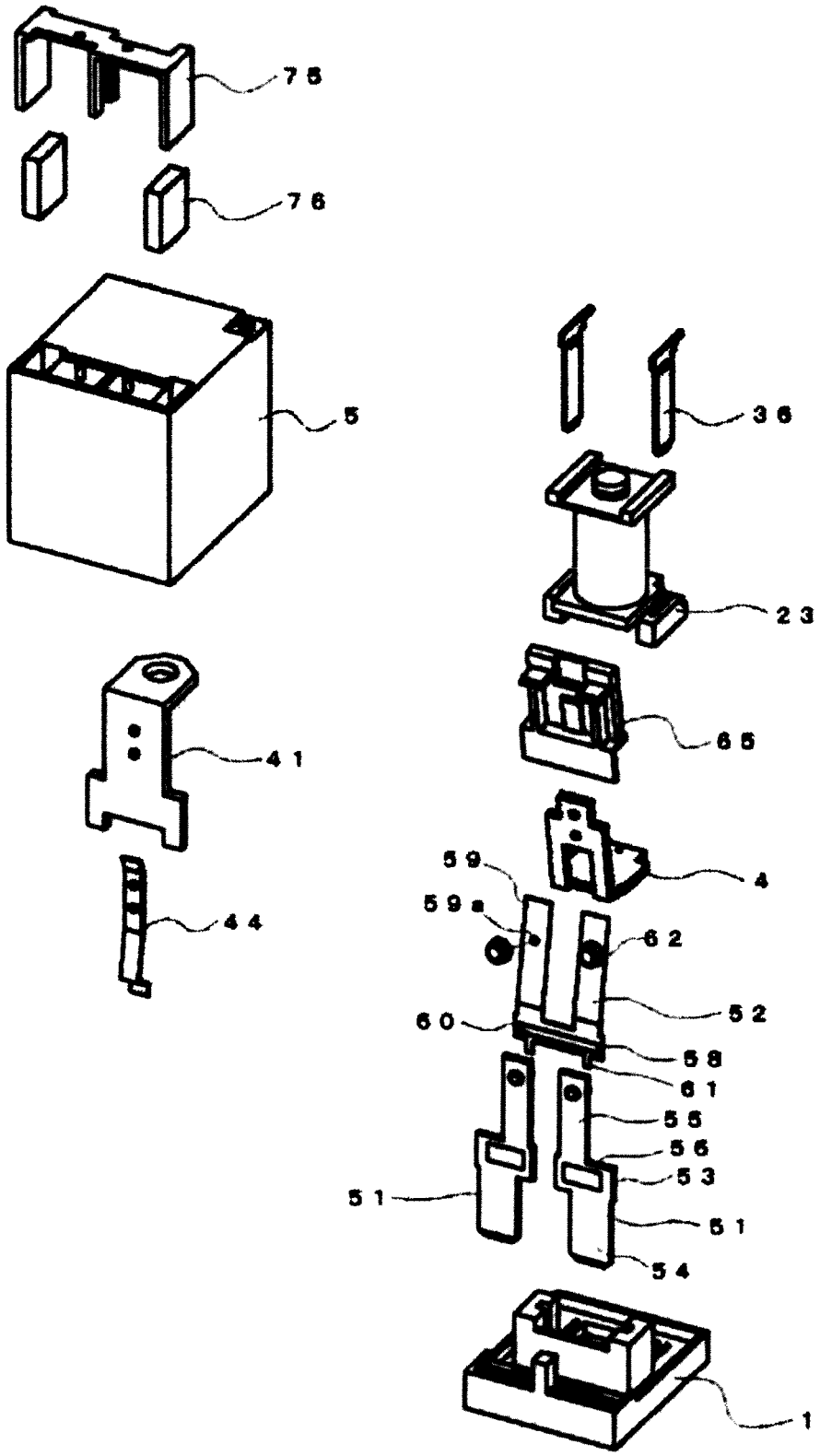
FIG. 4 is an exploded perspective view of the structure of FIG. 1.
Figure 5:
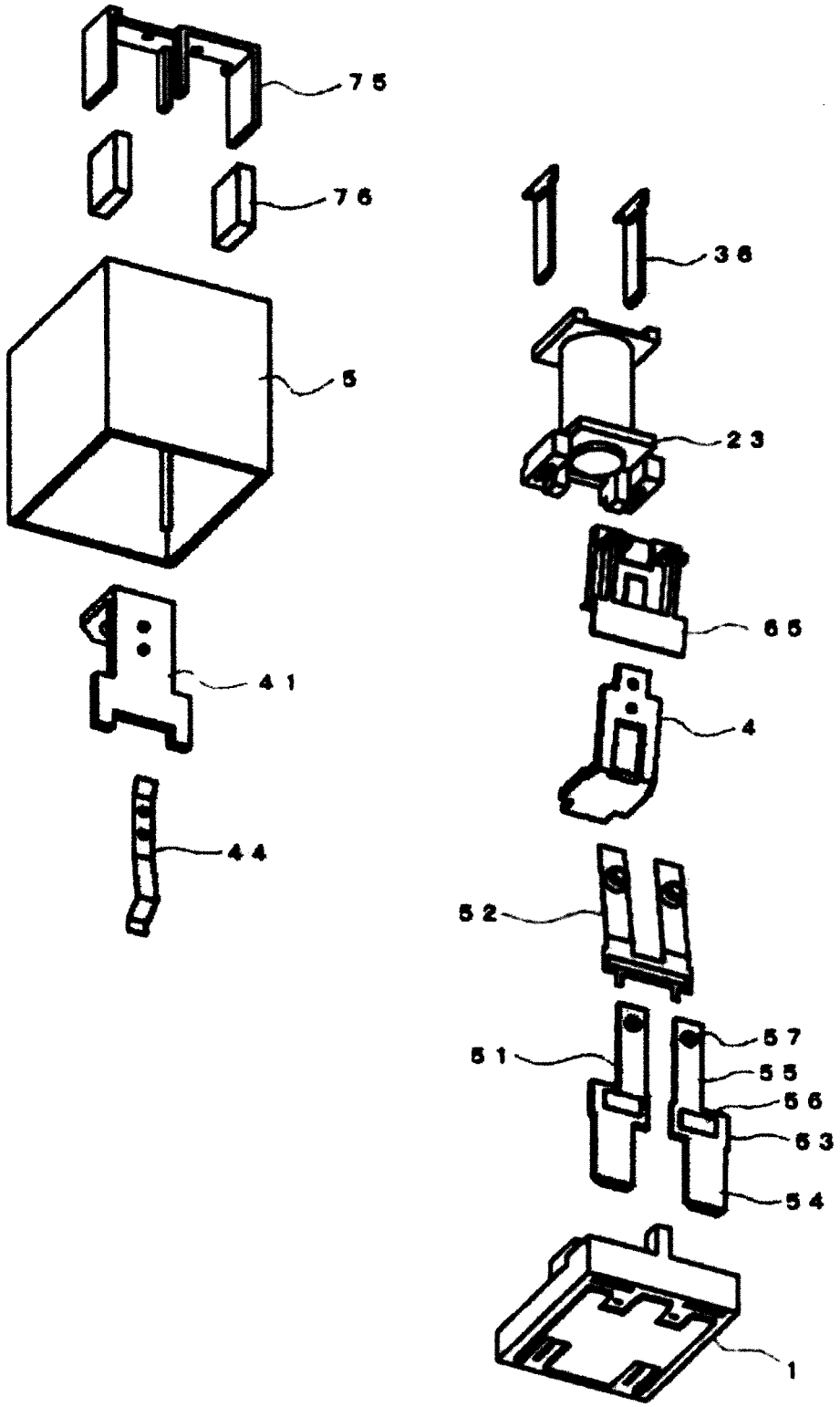
FIG. 5 is an exploded perspective view illustrating the state of FIG. 4 viewed from the opposite side.

The contact switching unit 3, as illustrated in FIGS. 4 and 5, includes the fixed contact pieces 51 and the movable contact piece 52, each of which is obtained by performing press working on an electrically conductive material such as copper.

The fixed contact piece 51 includes a press-fitted portion 53, a terminal portion 54 extending downward from the press-fitted portion 53, and a main body portion 55 extending upward from the press-fitted portion 53. The press-fitted portion 53 is provided with expansion portions 56 that are expanded from one surface of the press-fitted portion 53 by using the press working process. The press-fitted portion 53 can be press-fitted into a second terminal hole 21 of the base 1 by this expansion portions 56. The terminal portion 54 is narrower in width than the press-fitted portion 53, and is formed to be lopsided to one side of the press-fitted portion 53. The main body portion 55 is formed to be lopsided to the other side, which is opposite to a side where the terminal portion 54 is provided, and has a width half the width of the press-fitted portion 53. An upper end of the main body portion 55 is provided with a through-hole, and a fixed contact 57 is fastened to the upper end of the main body portion 55.

The movable contact piece 52 includes a press-fitted portion 58 and a pair of main body portions 59 extending upward from both sides of the press-fitted portion 58, respectively.

At a center portion of the press-fitted portion 58 in the vertical direction, an expansion portion 60 extending in the widthwise direction is formed like in the fixed contact piece 51. The expansion portion 60 can be press-fitted into the first terminal hole 18 of the base 1. Moreover, a pair of projections 61 that project downward are respectively formed at both ends of a lower edge of the press-fitted portion 58.

Figure 13:
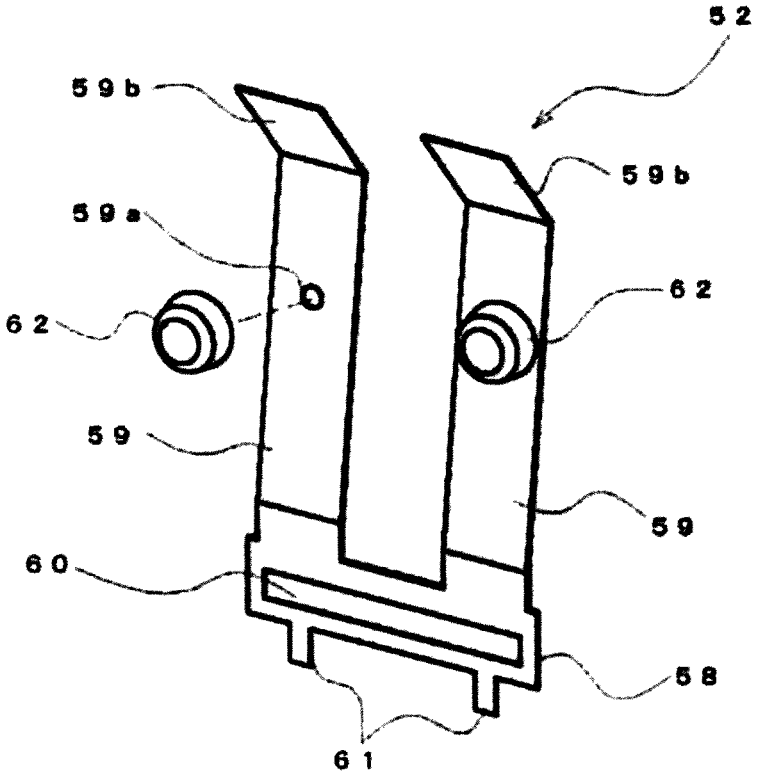
FIG. 13 is an enlarged perspective view that illustrates the movable contact piece of FIG. 4.

The main body portion 59 extends by being at a location near the press-fitted portion 58 and has a through-hole 59*a* at an upper end portion thereof. The movable contact 62 is fastened to the through-hole. Moreover, at an upper end of the main body portion 59, an extension 59*b* is formed to diagonally bend upward toward the fixed contact piece 51 as illustrated in FIG. 13. An inclination angle of the extension 59*b* with respect to the main body portion 59 is about 140 degrees in this case. However, it may be freely selectable as long as it is within a range of about 140 to 90 degrees. In addition, a distal end portion of the extension 59*b* in the perpendicular direction to the main body portion 59 is located at a position which protrudes more than the movable contact 62.

Figure 10:
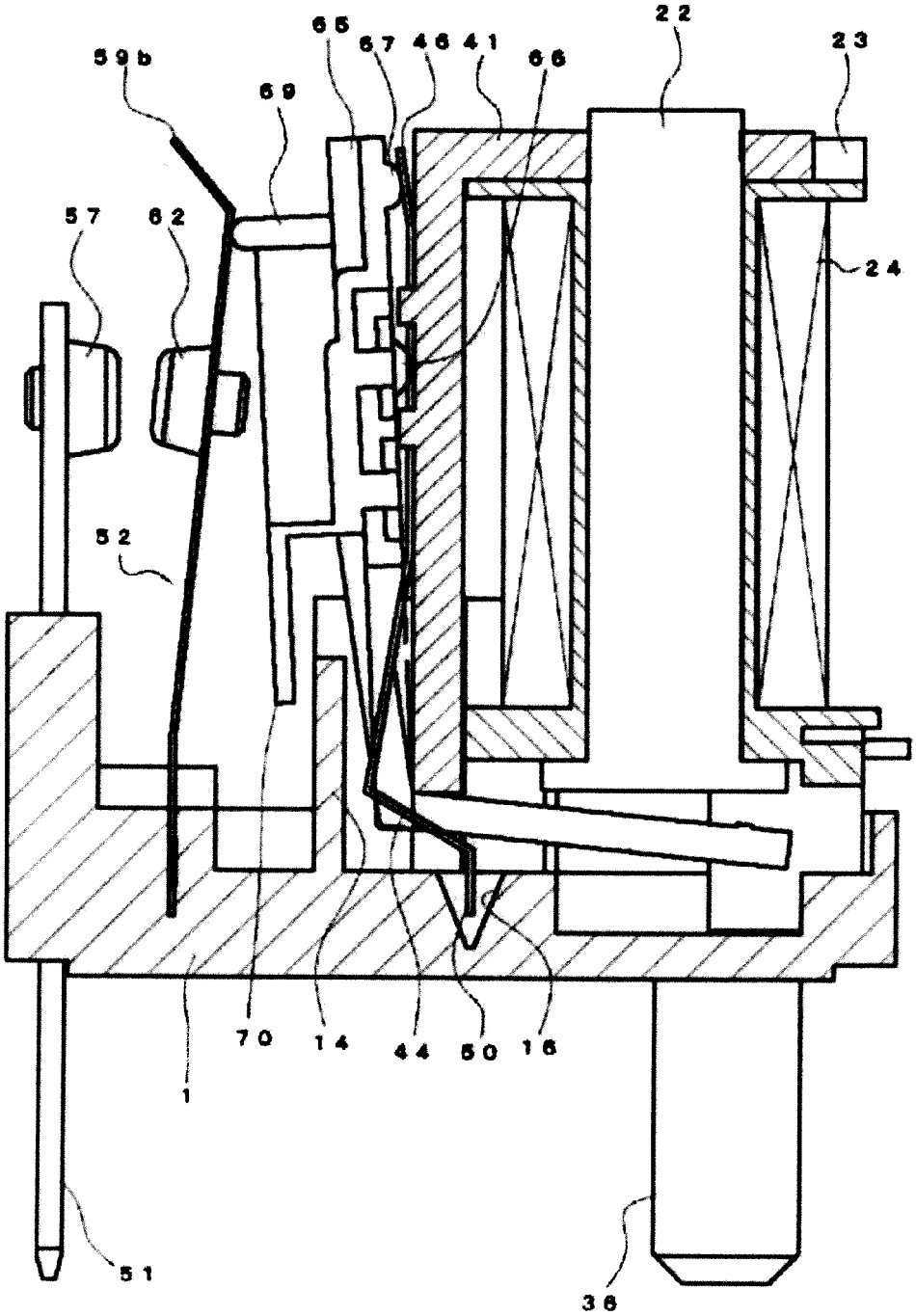
FIG. 10 is a cross-sectional view illustrating a state in which the case is removed from the structure of FIG. 1 when the contact is open.
Figure 11:
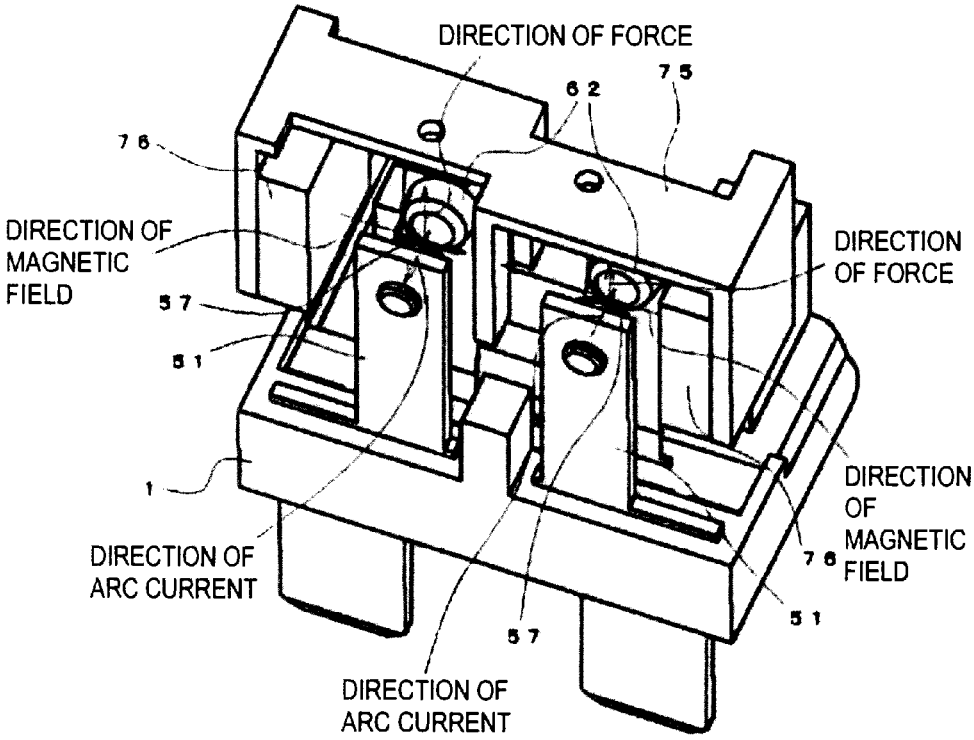
FIG. 11 is an enlarged perspective view of a contact switching unit of FIG. 3.

The movable contact piece 52 is arranged such that the movable contact 62 can move closer to and away from the fixed contact 57 of the fixed contact piece 51 which is press-fitted into the second terminal hole 21 in a state in which the press-fitted portion 58 is press-fitted into the first terminal hole 18 of the base 1. Therefore, in this state, as described above, the distal end portion of the extension 59*b* protrudes more than the movable contact 62, as illustrated in FIG. 10, it is close to the fixed contact 57. Accordingly, even if the arc is generated between the contacts, this arc extends to the distal end of the extension 59*b* and is promptly extinguished through the extension.

1-4. Movable Iron Piece 4

The movable iron piece 4 is formed by performing press working on a plate of a magnetic material so that the plate becomes substantially an L shape as shown in FIGS. 7 and 8. An end portion of the movable iron piece 4 is a to-be-attracted portion 63 which is to be attracted to the magnetic pole portion 25 of the iron core 22. A distal end portion and a base portion of the to-be-attracted portion 63 has a small width, so that an interference between the protruding portions 42 formed in the lower end portion of the yoke 41 and the guide protrusion 35 formed in the bottom surface of the spool 23 can be avoided. The other end portion of the movable iron piece 4 is provided with an opening 64. The hinge spring 44 passes through the opening 64, and comes in pressure-contact with a corner portion of the to-be-attracted portion 63. The other end portion of the movable iron piece 4 has a small width, and the card member 65 is integrally formed with an upper portion of the movable iron piece 4 which is disposed on the upper side of the opening 64.

The card member 65 is made of a synthetic resin material. On one surface of the card member 65 from which the upper end portion of the movable iron piece 4 which is integrally formed with the card member 65 is exposed, first protruding portions 66 are formed at both sides of the upper end portion of the movable iron piece 4, respectively, and a second protruding portion 67 is formed at an upper side of the first protruding portions 66. When the to-be attracted portion 63 of the movable iron piece 4 is separated from the magnet pole portion 25 of the iron core 22, the elastic contact portion 46 of the hinge spring 44 collides with the second protruding portion 67, and after which the first protruding portion 66 comes into contact with the yoke 41. On the other surface of the card member 65, projection portions 68 extending in the vertical direction are formed at a predetermined interval in the widthwise direction. Pressing portions 69 which more project than the projection portions 68 are formed at upper ends of the projection portions 68, respectively, so that the pressing portions 69 can press the upper ends of the main body portions 59 of the movable contact piece 52. A shield wall 70 which protrudes more than the other surface and extends downward is formed at a lower end portion of the card member 65.

1-5. Case 5

Figure 2:
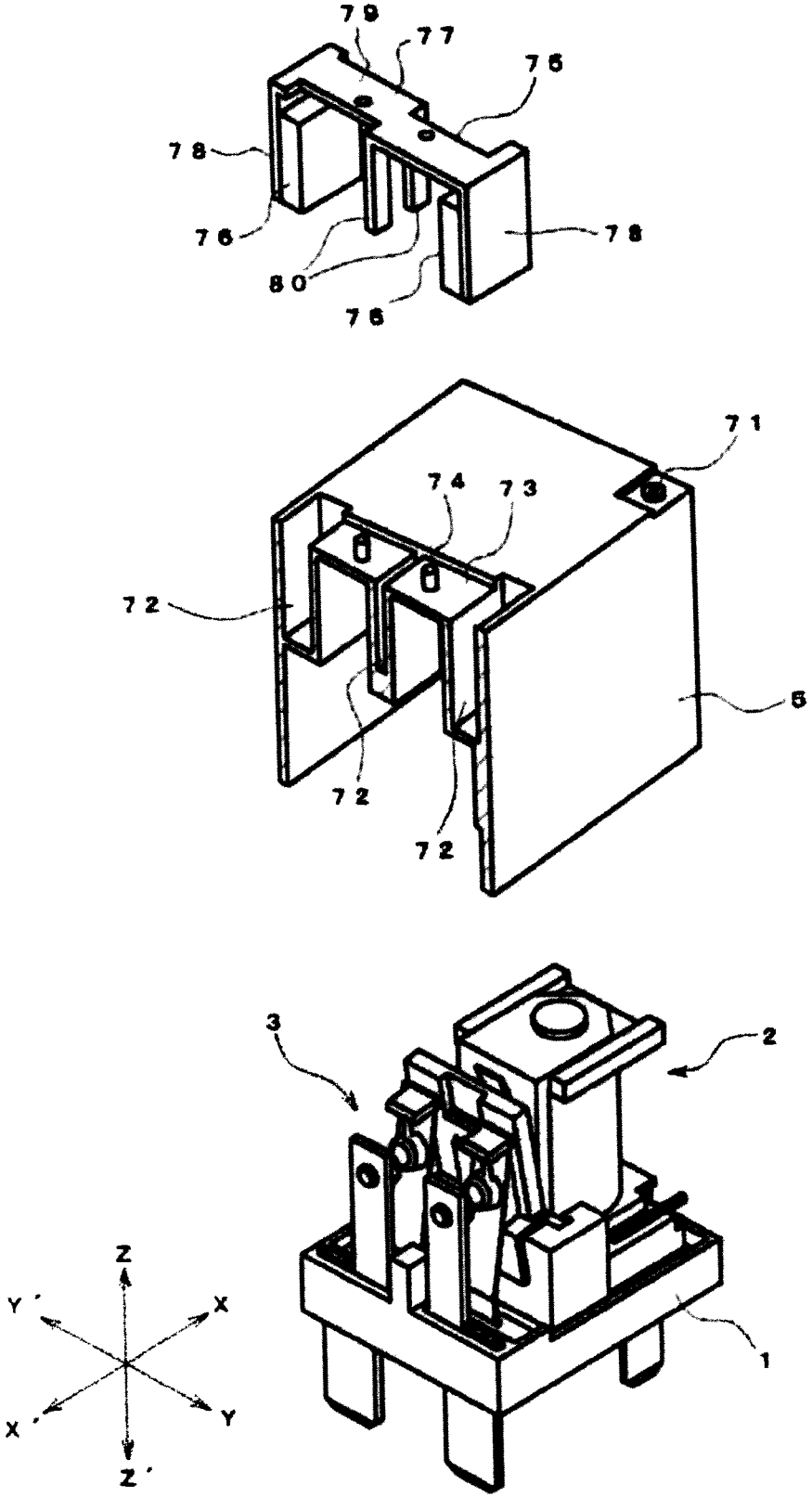
FIG. 2 is a perspective view illustrating a state in which the structure of FIG. 1 is disassembled so that a case and an arc-extinguishing member are separated from each other.
Figure 3:
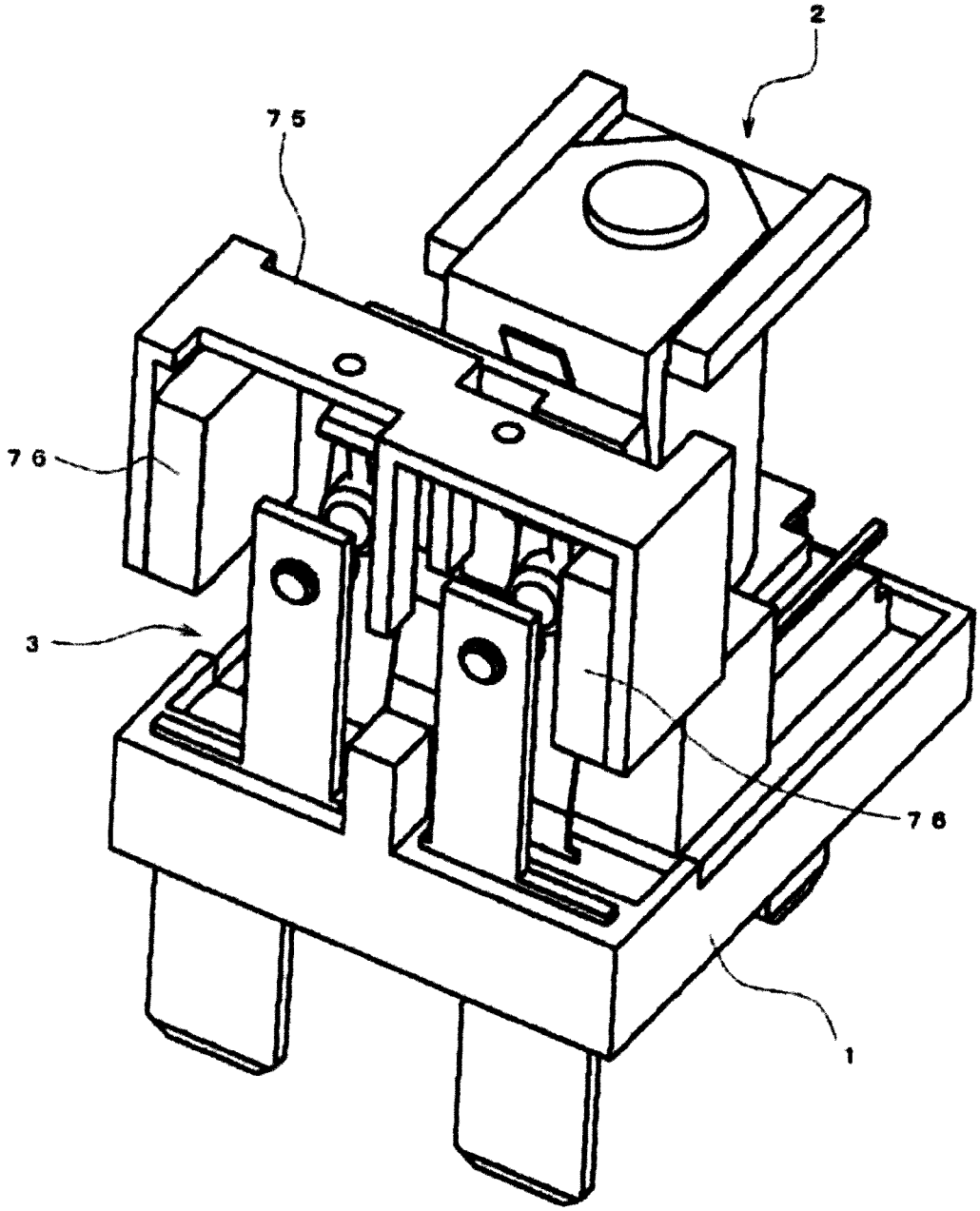
FIG. 3 is a perspective view illustrating a state in which only the case is removed from the structure of FIG. 1.

The case 5 has a box shape which is open at a lower end as shown in FIG. 2 and is made of a synthetic resin material. The case 5 has a sealing hole 71 in a corner of an upper surface. After a fitting portion of the base 1 and the case 5 is sealed, the sealing hole 71 is closed by heat sealing. At an edge of the upper surface of the case 5 on the opposite side of the sealing hole 71, slit-like concave portions 72 are formed at both side portions and a center portion, respectively. A recess 73 that is recessed from the upper surface of the case 5 is formed every between the concave portions 72, and a projection 74 is formed at a center portion of the surface of the recess 73.

An arc-extinguishing member 75 is attached to the case 5 using the concave portions 72 and the recess 73.

The arc-extinguishing member 75 includes a pair of permanent magnets 76, arranged at a predetermined interval, for extinguishing the arc and a joint member 77, made of a magnetic material, for magnetically connecting these permanent magnets 76.

The permanent magnets 76 have an almost rectangular parallelepiped shape and are arranged such that opposite sides of the permanent magnets 76 may have different polarities in a state in which the permanent magnets 76 are attached to the opposite inside walls 78 of the joint member 77. However, the polarities of the opposing surfaces may be set such that the direction of force exerting on the arc current which changes according to the direction of the current flowing at a contact point is directed toward a middle wall 79 of the joint member 77 to be described later.

The joint member 77 is formed by performing press working on a plate of a magnetic material such that both ends are bent so as to face each other. The permanent magnets 76 are attracted and fixed to the inside surfaces of the opposing walls 78, respectively. In the middle wall 79 of the joint member 77, both side portions of the middle wall 79 are cut away at different locations which are nearer opposite ends, respectively, so that middle protruding portions 80 are formed between the opposing walls 78. Each of the middle protruding portions 80 serves to shorten a magnetic path by being located in the middle portion between both the opposing walls 78 and protruding between both contact switching positions. That is, in a magnetic circuit, a closed loop is formed such that the magnetic flux generated from each of the permanent magnets 76 passes the middle wall 79 and each of the opposing walls 78 via the middle protruding portions 80, and returns to the permanent magnets 76.

As described above, the arc-extinguishing member 75 is provided with not only the pair of permanent magnets 76 but also the joint member 77 to magnetically connect the permanent magnets 76. Therefore, the magnetic circuit is formed, and as a result, it becomes difficult for the magnetic flux to leak. Moreover, since the middle protruding portions 80 are provided, the magnetic path can be shortened. Therefore, magnetic efficiency can be improved. Accordingly, even if an arc occurs at the time when the contact is opened or closed, this arc elongates to the sides according to the Fleming's left hand rule, and as a result, the arc is extinguished in a short time.

2. Assembling Method

Next, a method of assembling an electromagnetic relay having the structure described above is described.

The coil 24 is wound around the trunk 27 of the spool 23, and the coil terminal 36 is press-fitted and fixed to the lower-end flange 29. Both ends of the coil 24 are wound around the coil winding portion 39 and soldered. Moreover, the iron core 22 is inserted to pass through the center hole 26 of the spool 23 from the lower end of the spool 23, and the yoke 41 to which the hinge spring 44 is attached beforehand is fastened to the a portion of the iron core 22 which is exposed from the upper end of the spool. As a result, the electromagnet block 2 is completed assembled.

In the finished electromagnet block 2, the movable iron piece 4 is supported in a turnable manner on the lower end of the yoke 41 by using the hinge spring 44. Under this condition, the first protruding portion 66 of the card member 65 which is integrally formed with the movable iron piece 4 can come into contact with the yoke 41, and the elastic contact portion 46 of the hinge spring 44 can move closer to and away from the second protruding portion 67 of the card member 65. Next, the electromagnet block 2 to which the movable iron piece 4 is attached, and the contact switching unit 3 is installed in the base 1.

When installing the electromagnet block 2, the coil terminal 36 is press-fitted into the coil terminal hole 11 of the base 1, and both the sides portions of the yoke 41 are inserted into the guide grooves 15 of the guide wall 13. In the installed state, the guide protrusion 35 is located in the supporting concave portion 10, and the electromagnet block 2 is positioned on one side thereof in the direction of YY'. Moreover, the lower end surface of the protruding portion 42 of the yoke 41 and the bottom surface of the terminal attachment portion 31 come in contact with the bottom surface of the recesses 9 of the base 1, respectively. As a result, a gap is formed between the bottom surface of the recess 9 of the base 1 and the bottom surface of the lower-end flange 29 of the spool 23, and the movable iron piece 4 is be turnable in the gap. The shield wall 70 of the card member 65 which is integrally formed with the movable iron piece 4 is arranged over the insulation wall 14 of the base 1. At this time, the insulation performance between the electromagnet block 2 and the contact switching unit 3 is sufficiently secured due to the presence of the guide wall 13 and insulation wall 14 of the base 1, and an upper portion of the card member 65 and the shield wall 70.

When installing the contact switching unit 3, the press-fitted portion 58 of the movable contact piece 52 is press-fitted into the first terminal hole 18 of the base 1. When installing the movable contact piece 52, since the projection 61 is located in the communicating portion 19, the installation state of the movable contact piece 52 can be confirmed by viewing the bottom surface of the base 1. Moreover, the pressing portion 69 of the card member 65 which has been installed beforehand comes in pressure-contact with the upper end portion of the movable contact piece 52, and the movable iron piece 4 is positioned at the default position at which the to-be-attracted portion 63 is separated from the magnetic pole portion 25 of the iron core 22 due to the elastic force of the movable contact piece 52.

Moreover, the terminal portion 54 of the fixed contact piece 51 is inserted into the second terminal hole 21 of the base 1, and the press-fitted portion 53 is then press-fitted for fixing. In this state, the fixed contact piece 51 faces the movable contact piece 52 with a predetermined distance between the fixed contact piece 51 and the movable contact piece 52, and the movable contact 62 becomes contactable to the fixed contact 57. Moreover, the distal end portion of the extension **59*b* extending from the upper end of the movable contact piece 52 protrudes, from the main body portion 59, toward the fixed contact piece 51, within a predetermined region which exists in a direction along which the arc is extended by the permanent magnet 76** as described below.

Moreover, the arc-extinguishing member 75 is installed in the case 5. When installing the arc-extinguishing member 75, in the state in which the permanent magnets 76 are attached to the opposing walls 78 of the joint member 77, the opposing walls 78 of the joint member 77, the permanent magnets 76, and the middle protruding portion 80 are inserted into the respective concave portions 72 formed in the case 5. Subsequently, the base 1 is encased in the case 5 with the arc-extinguishing member 75 attached to the base, and the fitting portion therebetween is sealed.

In addition, an internal space may be sealed by heat-sealing a sealing hole 71. However, the sealing hole 71 may be used in a state where the sealing hole 71 is kept being open and the internal space is allowed to be in communication with a surrounding atmosphere.

3. Operation

Next, the operation of the electromagnetic relay having the above-described structure will be described.

Under a condition in which the coil 24 is not energized and the electromagnet block 2 is demagnetized, the movable iron piece 4 is located at the default position at which the to-be-attracted portion 63 is separated from the magnetic pole portion 25 of the iron core 22 because the movable iron piece 4 causes the to-be-attracted portion 63 to turn about the fulcrum supported by the yoke 41 by using the elastic force of the movable contact piece 52. Therefore, the movable contact 62 maintains the open state in which the movable contact 62 is separated from the fixed contact 57.

Figure 9:
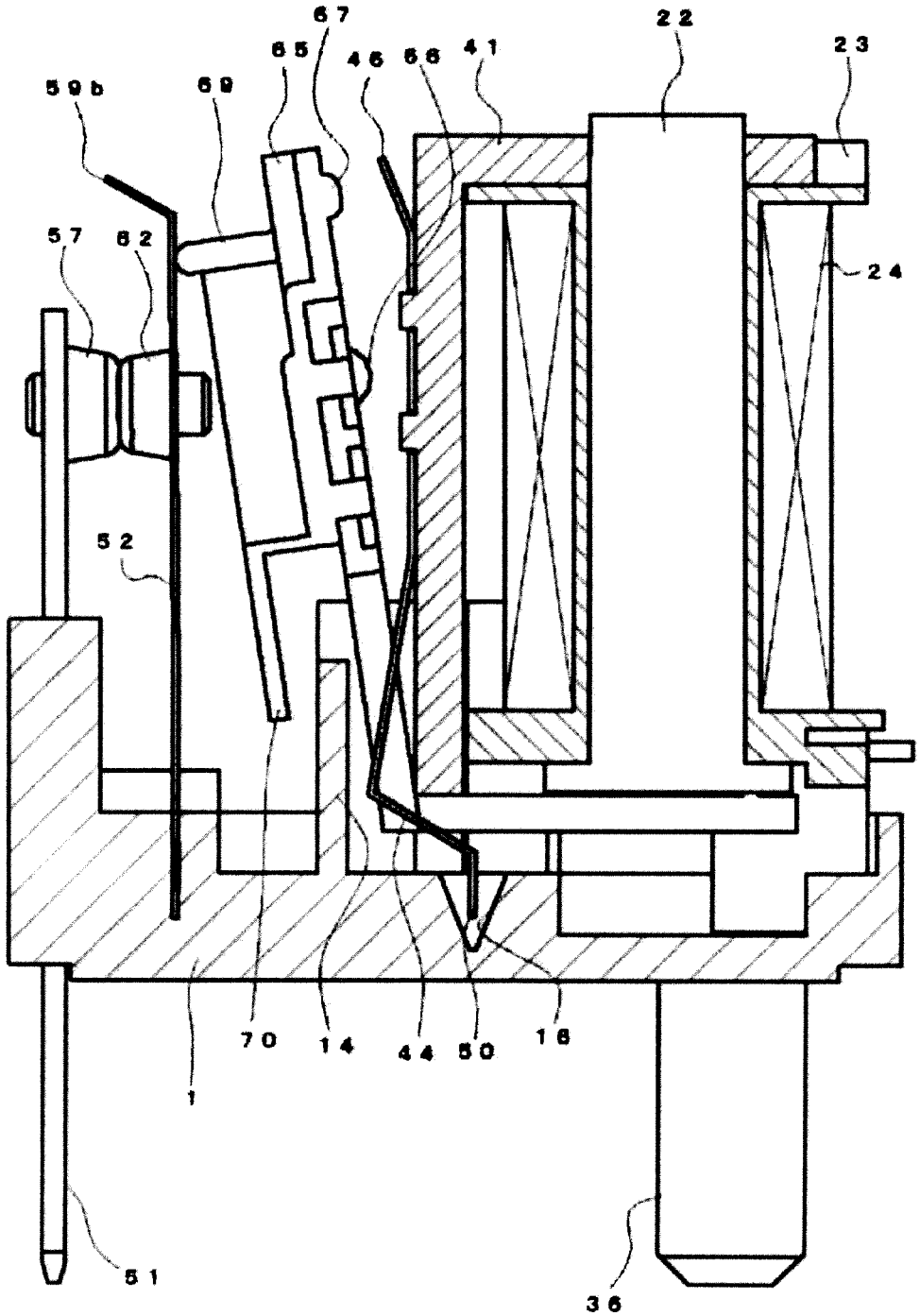
FIG. 9 is a cross-sectional view illustrating a state in which the case is removed from the structure of FIG. 1 when a relay contact is closed.

When the coil 24 is energized and the electromagnet block 2 is excited, the to-be-attracted portion 63 of the movable iron piece 4 is attracted to the magnetic pole portion 25 of the iron core 22 and turns against the biasing force of the movable contact piece 52 as shown in FIG. 9. Such an operation allows the movable contact piece 52 to be elastically deformed and allows the movable contact 62 to be in contact with the fixed contact 57 of the fixed contact piece 51.

When energizing the coil 24 is stopped and the electromagnet block 2 is demagnetized, the movable iron piece 4 is not attracted by the iron core 22 anymore so that the movable iron piece 4 turns due to the elastomeric force of the movable contact piece 52. At this time, the second protruding portion 67 formed on the card member 65 of the movable iron piece 4 collides with the elastic contact portion 46 of the hinge spring 44. The second protruding portion 67 is made of a synthetic resin so that the elastic contact portion 46 is elastically deformed. However, a contact state of the second protruding portion 67 and the elastic contact portion 46 is obtained within a short time after the movable iron piece 4 starts turning. Accordingly, nearly no collision noise is generated. Then, as the movable iron piece 4 turns further, the elastic contact portion 46 is elastically deformed and the first protruding portion 66 made of a synthetic resin comes into contact with the middle portion of the yoke 41. Accordingly, the turning speed of the movable iron piece 4 is reduced, and this also serves to sufficiently suppress generation of the collision noise. In this way, the movable iron piece 4 smoothly returns to the default position without generating the collision noise and the movable contact 62 is separated from the fixed contact 57 and is positioned at an open position.

Incidentally, at the time when the contact is opened, an arc might occur between contact points. In this case, the arc-extinguishing member 75 is disposed around a contact switching region, and the extension 59*b* is formed at the upper end of the movable contact piece 52. For this reason, the generated arc is promptly extinguished.

That is, the magnetic flux generated from the N pole of each of the permanent magnets 76 runs in a magnetic circuit in which the magnetic flux passes the middle wall 79 via the middle protruding portions 80 of the joint member 77, and returns to the S pole of each of the permanent magnet 76 from the opposing walls 78. Each magnetic circuit forms a closed-loop so that nearly zero magnetic flux leaks to surroundings. Moreover, because of the presence of the middle protruding portion 80, the magnetism can be effectively exerted on the arc generated at the contact switching position, in other words, between the contacts points. As a result, according to the Fleming's left hand rule, force is exerted on the generated arc in a direction orthogonal to the direction in which the contact is opened, so that this arc is extended over a long distance. In addition, the distal end portion of the extension 59*b* formed at the upper end of the movable contact piece 52 is positioned in the direction in which the arc is extended. Accordingly, the generated arc arrives at the distal end portion of the extension, which is the nearest position over the extension, so that it is promptly extinguished.

Moreover, an operating voltage of the electromagnet block 2 can be adjusted as follows.

Figure 12:
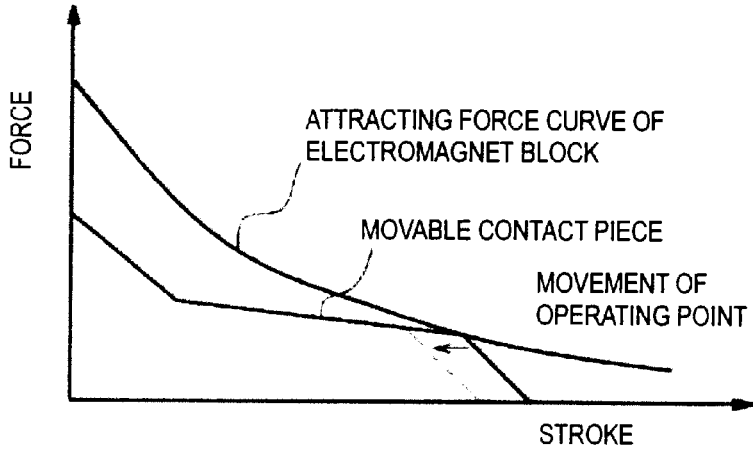
FIG. 12 is a graph illustrating an attracting force curve of the electromagnet block of FIG. 4 and a change in force exerting on a movable contact piece.

That is, the operating voltage of the electromagnet block 2 can be controlled by changing the inclination angle of the elastic contact portion 46 of the hinge spring 44. In greater detail, if the inclination angle of the elastic contact portion 46 with respect to the yoke 41 is increased, the position of an operating point can be changed in accordance with a change in the force (attracting force curve) that exerts on the to-be-attracted portion 63 of the movable iron piece 4 due to the magnetic field generated from the magnetic pole portion 25 of the iron core 22 as shown in the graph of FIG. 12. That is, the force needed for a period from the opening of the contacts to the timing at which the elastic contact portion 46 comes into contact with the first protruding portion 66 can be reduced by increasing the inclination angle of the elastic contact portion 46. Accordingly, the operating voltage of the electromagnet block 2 can be controlled such that the attracting force curve can change in a narrower range than that of FIG. 12.

The present embodiments are not limited to the structures described, and can be modified in various ways.

In the above embodiment, the extension 59*b* is formed at the upper end of the movable contact piece 52. However, the extension may be formed at the upper end of the fixed contact piece 51, or may be formed in both of the movable contact piece 52 and the fixed contact piece 51. In the case where both of the contact pieces are provided with the extensions, the positional relation between the extensions needs to be sufficiently paid attention to so that the extensions may not be short-circuited. For example, this problem may be addressed by devising the positional relationship between the extensions such that the main body portions are disposed to be misaligned with each other in the lengthwise direction.

Figure 14:
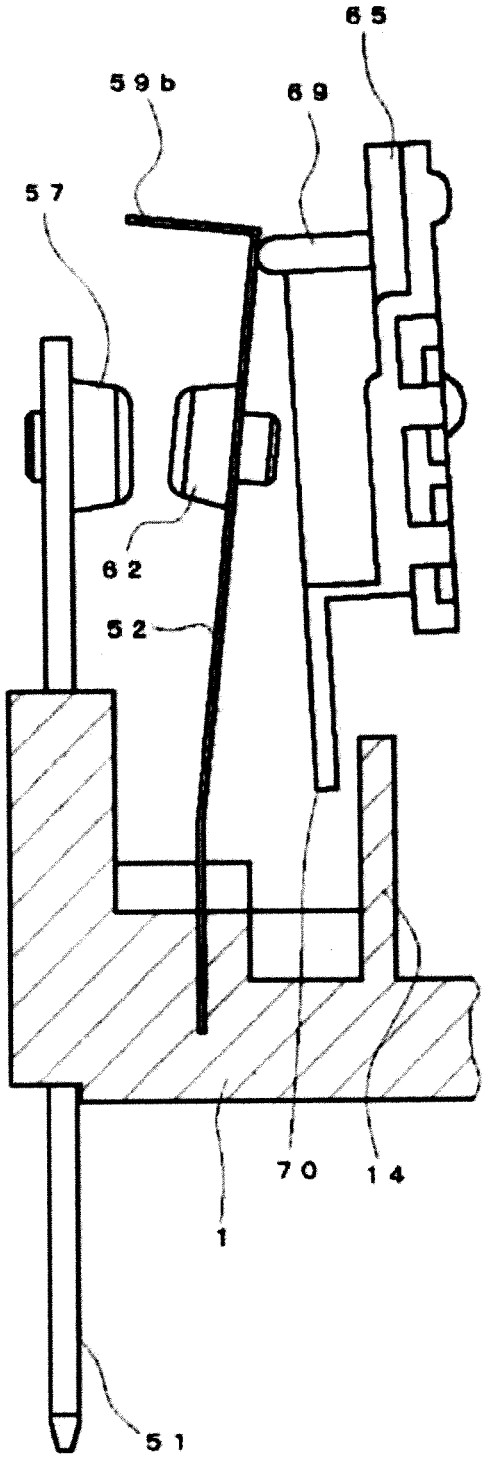
FIG. 14 is a partial enlarged perspective view that illustrates a contact switching mechanism of an electromagnetic relay according to another embodiment.

In addition, in the above embodiment, the extension 59*b* is configured to have an angle of 140 degrees with respect to the main body portion 59, but the angle can be flexibly selectable within a range up to 90 degrees. However, as illustrated in FIG. 14, it is most preferable that the angle is about 90 degrees. When the angle is larger than 140 degrees, the dimension of protrusion in the direction perpendicular to the main body portion 59 is relatively large compared with that of the movable contact 62. Accordingly, the extension 59*b* is excessively long in length. On the other hand, when the angle is smaller than 90 degrees, since the extensions are too much close to the respective contacts, the short-circuited state is likely to occur. Therefore, the angle formed between the main body portion 59 and the extension 59*b* is in a range of 90 to 140 degrees.

The contact switching mechanism according to the present embodiments can be adopted not only by the electromagnetic relay but also by any electronic device as long as the electronic device includes a mechanism in which contacts open and close like in a switch and an arc occurs between the contacts.

There has thus been shown and described a novel contact switching mechanism and electromagnetic relay using the same which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A contact switching mechanism comprising:

a fixed contact piece with a fixed contact;

a movable contact piece with a movable contact that faces the fixed contact in a contactable manner and;

a magnet that extends an arc generated between the fixed contact and the movable contact to an extension, wherein:

the fixed contact piece includes a first fixed portion that is configured to fix to a base and a first main body portion that is configured to protrude from the base and includes the fixed contact, the movable contact piece includes a second fixed portion fixed to the base and a second main body portion that protrudes from the base and includes the movable contact, at least one of the fixed contact piece and the movable contact piece includes the extension that extends toward the other contact piece and the extension is at the end of at least one of the fixed contact piece and movable contact piece opposite to the first or second fixed portion so that the fixed or movable contact is positioned between the first or second fixed portion, and the extension.

2. The contact switching mechanism according to claim 1, wherein the extension protrudes more from one of the first main body portion and the second main body portion than one of the fixed contact that protrudes from the first main body portion and the movable contact that protrudes from the second main body portion.

3. The contact switching mechanism according to claim 1, wherein the extension is formed by bending one of the first main body portion and the second main body portion.

4. The contact switching mechanism according to claim 2, wherein the extension is formed by bending one of the first main body portion and the second main body portion.

5. The contact switching mechanism according to claim 3, wherein the extension is formed by bending one of the first main body portion and the second main body portion at a substantially right angle.

6. The contact switching mechanism according to claim 4, wherein the extension is formed by bending one of the first main body portion and the second main body portion at a substantially right angle.

7. An electromagnetic relay comprising:

a contact switching mechanism that comprises:

a fixed contact piece with a fixed contact; and a movable contact piece with a movable contact that faces the fixed contact in a contactable manner, wherein:

the fixed contact piece includes a first fixed portion fixed to a base and a first main body portion that protrudes from the base and includes the fixed contact, the movable contact piece includes a second fixed portion fixed to the base and a second main body portion that protrudes from the base and includes the movable contact, at least one of the fixed contact piece and the movable contact piece includes an extension that extends toward the other contact piece and the extension is at the end of the fixed or movable contact piece opposite to the first or second fixed portion so that the fixed or movable contact is positioned between the first or second fixed portion and the extension.

8. The electromagnetic relay according to claim 7, wherein the extension protrudes more from the at least one of the fixed contact piece and the movable contact piece than one of the fixed contact that protrudes from the first main body portion and the movable contact that protrudes from the second main body portion.

9. The electromagnetic relay according to claim 7, wherein the extension is formed by bending one of the first main body portion and the second main body portion.

10. The electromagnetic relay according to claim 8, wherein the extension is formed by bending one of the first main body portion and the second main body portion.

11. The electromagnetic relay according to claim 9, wherein the extension is formed by bending one of the first main body portion and the second main body portion at a substantially right angle.

12. The electromagnetic relay according to claim 10, wherein the extension is formed by bending one of the first main body portion and the second main body portion at a substantially right angle.

13. The electromagnetic relay according to claim 7, further comprising a magnet that extends an arc generated between the fixed contact and the movable contact to the extension.

14. The electromagnetic relay according to claim 8, further comprising a magnet that extends an arc generated between the fixed contact and the movable contact to the extension.

* * * * *